United States Patent [19]

Rosen

[11] 4,091,758

[45] May 30, 1978

[54] WIND-CONTROL RUDDER FOR YACHTS

[76] Inventor: Carl-David Rosen, Karlavagen 21, S-352 44 Vaxjo, Sweden

[21] Appl. No.: 735,905

[22] Filed: Oct. 26, 1976

[30] Foreign Application Priority Data

Nov. 10, 1975 Sweden ..... 7512600

[51] Int. Cl.[2] ..... B63H 25/12

[52] U.S. Cl. ..... 114/144 C

[58] Field of Search ..... 114/144 C, 150, 146

[56] References Cited

U.S. PATENT DOCUMENTS

| | | | |
|---|---|---|---|
| 3,180,298 | 4/1965 | Gianoli | 114/144 C X |
| 3,906,881 | 9/1975 | von Trepka | 114/144 C |

*Primary Examiner*—Allen N. Knowles
*Assistant Examiner*—Edward M. Wacyra
*Attorney, Agent, or Firm*—Burns, Doane, Swecker & Mathis

[57] ABSTRACT

A wind-operated automatic steering gear for water-going vessels includes a wind vane, a main steering rudder, and a servo-rudder hinged to the rear end of the steering rudder. The wind vane is connected to the servo-rudder to move the latter and correct deviations in the course of vessel travel. A resetting mechanism is connected between the steering rudder and the wind vane to move the wind vane in response to movement of the steering rudder and thereby cause the wind vane to return to neutral position so that over correction of the vessel travel is prevented.

9 Claims, 7 Drawing Figures

16
16'
23
22
18
17
10
26
38
9
7
8
6
5
4
1
2
3

16
16'
31
32
38
35
9
3
2

WIND-CONTROL RUDDER FOR YACHTS

The present invention relates to wind-operated automatic steering gear comprising a wind vane and a transmission system having a pressure chamber filled with working fluid arranged to transmit movement of the wind vane to the rudder of a water-going vessel to which the gear is fitted, and vice versa.

One such automatic steering gear is known, for example, from Swedish Pat. Specification No. 7111031-6. In this known steering gear, the pressure chamber of the transmission system may comprise a hydraulic piston-cylinder arrangement or a bellows arrangement.

It has been found in practice that with a transmission system incorporating a hydraulic piston-cylinder arrangement, in low winds the response of the rudder to changes in course, detected by the wind vane, is poor, owing to friction losses in, inter alia, the transmission system. Moreover, a transmission system in which the pressure chamber comprises a piston-cylinder arrangement is expensive.

It has also been found in practice that a pressure chamber incorporating a bellows-arrangement does not transmit movement of the wind vane to the rudder in a sufficiently positive manner.

A further problem encountered with known, mechanical wind-operated automatic steering gear is the difficulty of damping the rudder so as not to overcompensate rudder movement for example.

An object of the present invention is therefore to provide a simple and inexpensive wind-operated automatic steering gear in which friction losses are lower than in known gear and which is more readily mounted to a vessel than known wind-operated automatic steering gear, and which can be arranged to counteract yawing movements normally executed by an automatically steered yacht.

Accordingly this invention consists in a wind-operated automatic steering gear comprising a wind vane, a servo-rudder and a closed movement-transmission system connecting said wind vane to said servo-rudder, wherein said transmission system is filled with a pressure-transmission medium and comprises a first pressure chamber, one side of which is defined by a first flexible diaphragm; a second pressure chamber, one side of which is defined by a second flexible diaphragm, said pressure chambers communicating with one another through at least one pressure-medium line, the arrangement being such that movement of one diaphragm is accompanied by a corresponding movement of the other diaphragm, wherein connected to said first diaphragm and said wind vane is a first actuating device effective to cause movement of said first diaphragm or said vane in response to movement of said vane or said first diaphragm respectively, and wherein said second diaphragm is connected to said servo-rudder by a further actuating device effective to move said second diaphragm or said servo rudder in response to movement of said servo rudder or said second diaphragm respectively.

So that the invention will be more readily understood and further features thereof made apparent, exemplary embodiments of the invention will now be described with reference to the accompanying schematic diagrams, in which:

FIGS. 1 and 2 show a first embodiment of the invention which, although not permitting damping of the main rudder, is of simple construction, inexpensive, readily mountable and highly sensitive.

Figure 1:
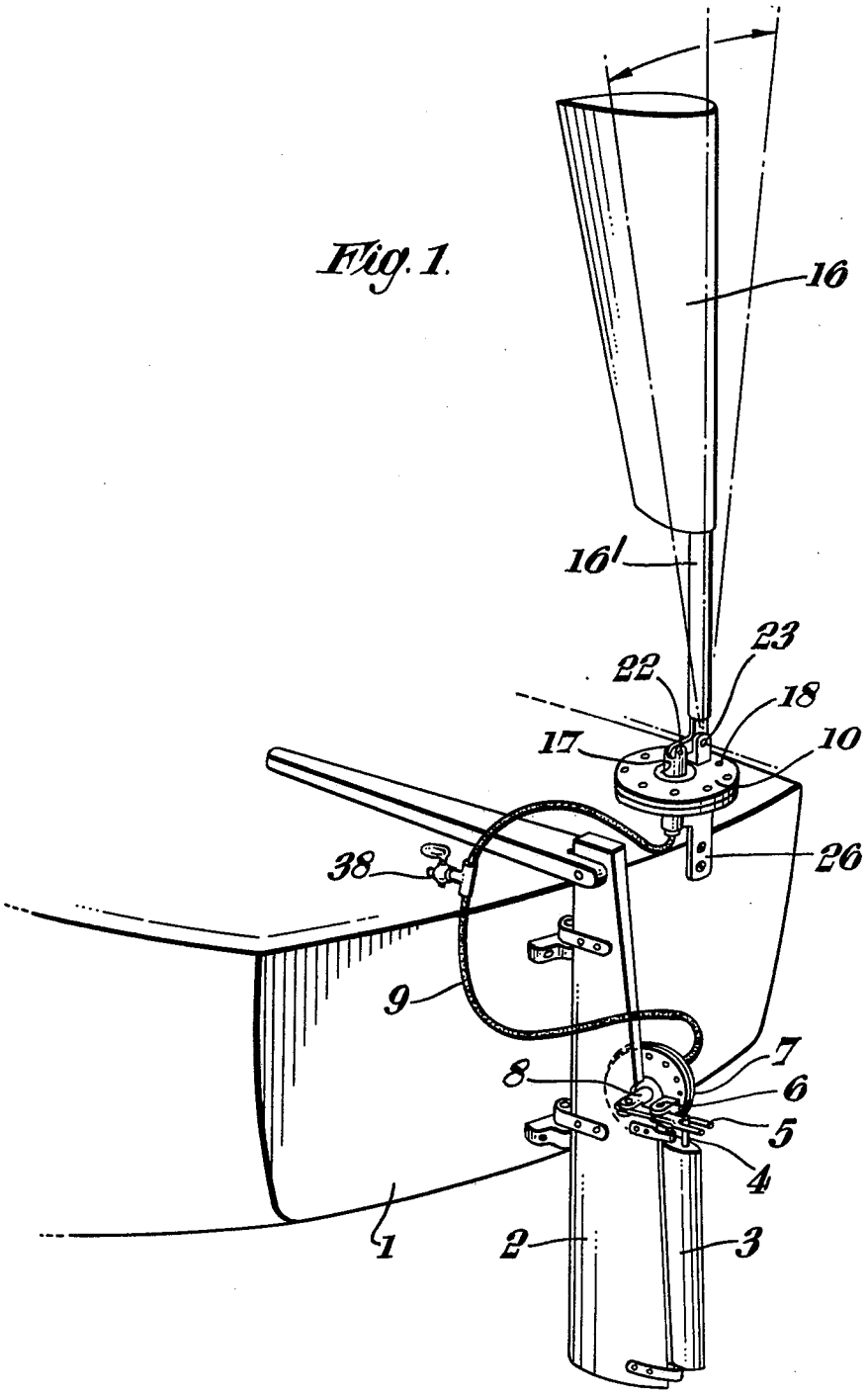
FIG. 1 shows the stern portion of a yacht having a wind-operated automatic steering gear according to the invention.
Figure 2:
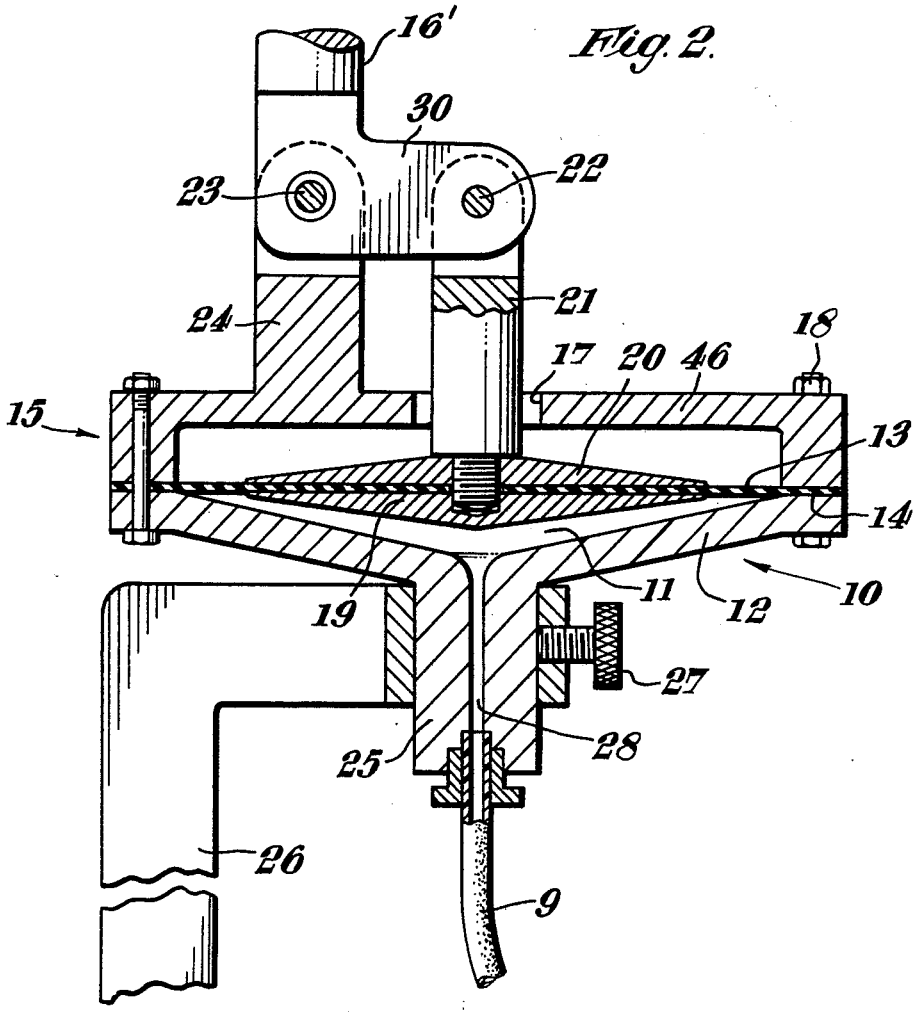
FIG. 2 is a sectional view of the pressure chamber of a movement transmission system and associated elements co-operating with a wind vane.

The reference 1 identifies the stern portion of a sailing boat having a main steering rudder 2, by which is meant here the standard rudder intended for manually steering the boat. Hinged to the after edge of the main rudder 2 is a servo rudder 3. On the upper end of the servo rudder 3 is a pin 4 arranged to co-act with a fork 5 which is pivotally mounted at its centre around a shaft 6 mounted on a lug projecting outwardly from a pressure chamber 7. The pressure chamber 7 may be of any suitable kind but is preferably of the kind hereinafter described with reference to the transmission of forces from the wind vane to the rudder. The pressure chamber 7 has a centrally arranged push-pull rod 8, the outer free end of which is pivotally connected to one end of the fork 5. The interior of the pressure chamber 7 is connected to a supply line for working medium, for example a rubber hose 9 which opens out into the interior 11 of further pressure chamber 10 arranged above the pressure chamber 7, as shown in FIG. 1. Referring now to FIG. 2, the upper pressure chamber 10 includes a housing 12 having an upper moveable wall portion comprising a diaphragm 13 which defines one wall of the pressure chamber and which is mounted in a gas-tight and a liquid-tight manner between an upper planar edge 14 of the housing 12 and a carrier means 15 for a wind vane 16 (FIG. 1). In the illustrated embodiment the housing 12 and the diaphragm 13 are of circular configuration. The carrier means comprises a cylindrical cap 46 having a central opening 17. The cap 46 is attached to the housing 12 by means of bolts 18. In the illustrated embodiment, the central portion of the diaphragm 13 is reinforced by means of a plate-like member comprising a half-plate 19 abutting the underside of the diaphragm and a half-plate 20 abutting the upper side thereof. The diaphragm is clamped between the half-plates 19 and 20 in a manner to provide a gas-tight and a liquid-tight connection screwed into the plates is a push-pull rod 21 which extends through an opening 17 in the upper wall of the housing 12. The end of the rod 21 remote from the half-plate 20 is connected, via a pin 22, to one end of a right-angled link-arm 30, the other end of which is firmly connected to a post 16' carrying the wind vane 16 and projects approximately perpendicularly to the long axis of said post in the illustrated embodiment. The link-arm 30 carrying the post 16' is pivotally mounted on a horizontal shaft 23 arranged on a member 24 projecting from the cap 16.

The bottom of the housing 12 is provided with a cylindrical elongate hub 25 which is pivotally mounted in a hole in a bracket structure 26 attached to the yacht. The wind vane thus mounted on is capable of pivoting together with the housing 12 and its associated pressure chamber. For the purpose of locking the wind vane 16 and the housing 12 in a selected position, dependent upon the course on which the boat is set and the direction of the prevailing wind there is provided a stop screw 27 which can be screwed into the bracket structure 26 such as to bring the inner end of the screw into locking engagement with the hub 25. As shown in FIG. 2, extending axially through the elongate hub 25 is a passage 28 which communicates with the interior of the tube or hose 9, thereby bringing the pressure chamber 11 into direct communication with the interior of the pressure chamber 7. As before mentioned, this latter chamber is preferably constructed in the same manner as the pressure chamber shown in FIG. 2, the rod 8 being connected to a diaphragm in the chamber 7 so that movement of said diaphragm causes corresponding movement of the push-pull rod and hence corresponding movement of the rudder 2. The two pressure chambers and the line 9 connecting said chambers form a closed gas-tight and liquid-tight system containing a force-transmitting medium, which although it may comprise a liquid is preferably air. Since a low pressure and low flow-rate prevail in the system and the volumes of air enclosed in the chambers are small in relation to the working surfaces of the respective diaphragms, relatively small movements of one diaphragm can be transmitted to the other diaphragm with a high degree of proportionality, and the amount of energy lost in the system is totally negligible, discounting the diaphragm forces. The system can therefore be dimensioned so that normal steering forces are transmitted with minimal losses while, on the other hand, abrupt changes in pressure are effectively damped, irrespective of whether such changes are caused by gusts of wind influencing the wind vane 16 or by sea movement producing impact forces on the main rudder and servo rudder. The ratio between diaphragm area and the through-flow area of the line must be high.

The aforedescribed wind-operated automatic steering gear has the following mode of operation. It is assumed that the vessel is sailing before the wind and that the housing 12, and thus the wind vane 16, are so locked by means of the screw 27 that the medium plane of the wind vane lies parallel to the fore-and-aft line of the vessel. The medium plane of the main rudder 2, which is freely pivotable, and of the servo rudder 3 will lie on a plane passing through the fore-and-aft line of the vessel. The same pressure will prevail in both pressure chambers which will have equal volumes. If the vessel deviates from its set course, for example to port, the wind vane 16 will obtain a corresponding angle of attack relative to the wind and will swing to starboard around the shaft 23. As a result, the link-arm 30 will pull the rod 21 upwards causing a decrease in pressure in the lower pressure chamber 7 which is thus reduced in volume and withdraws its pressure rod 8. Movement of the pressure rod 8 causes the servo rudder 3 to be pivoted to port which in turn causes the main rudder to be turned to starboard. The vessel will thus swing to starboard towards its original course and during this swing to starboard there will be a progressive change in volume in the two pressure chambers owing to movement of the wind vane with the rudder, the wind vane and the two diaphragms tending to return to their aforementioned starting position. Normally, however, there is a certain amount of over compensation and the vessel will thus, at times, continue beyond its original course and continue to move to starboard, wherewith the aforedescribed sequence of operations is repeated in the reverse direction.

Figure 3:
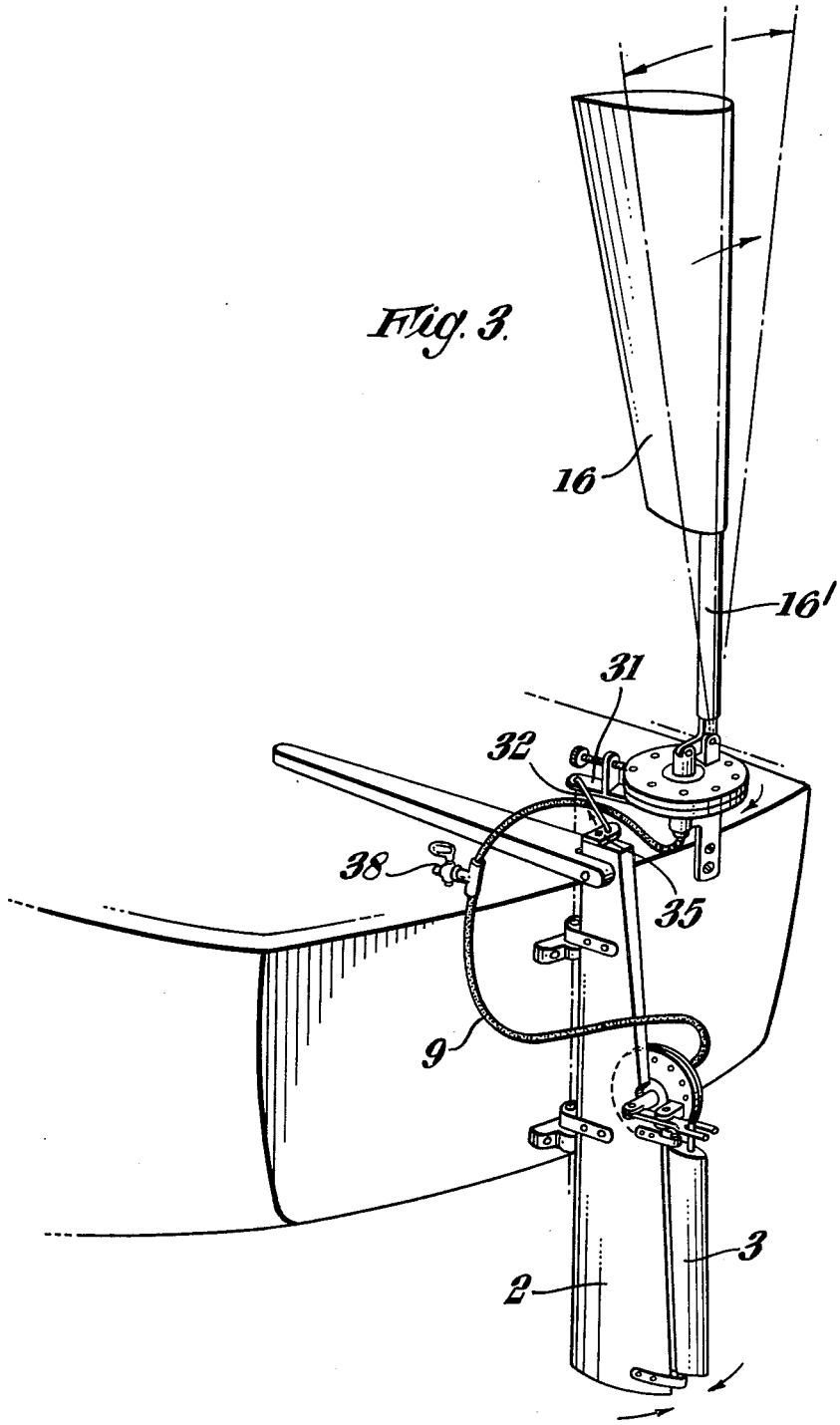
FIG. 3 shows the stern portion of a yacht provided with a modified wind-operated automatic steering gear according to the invention which provides for damping of the rudder.
Figure 4:
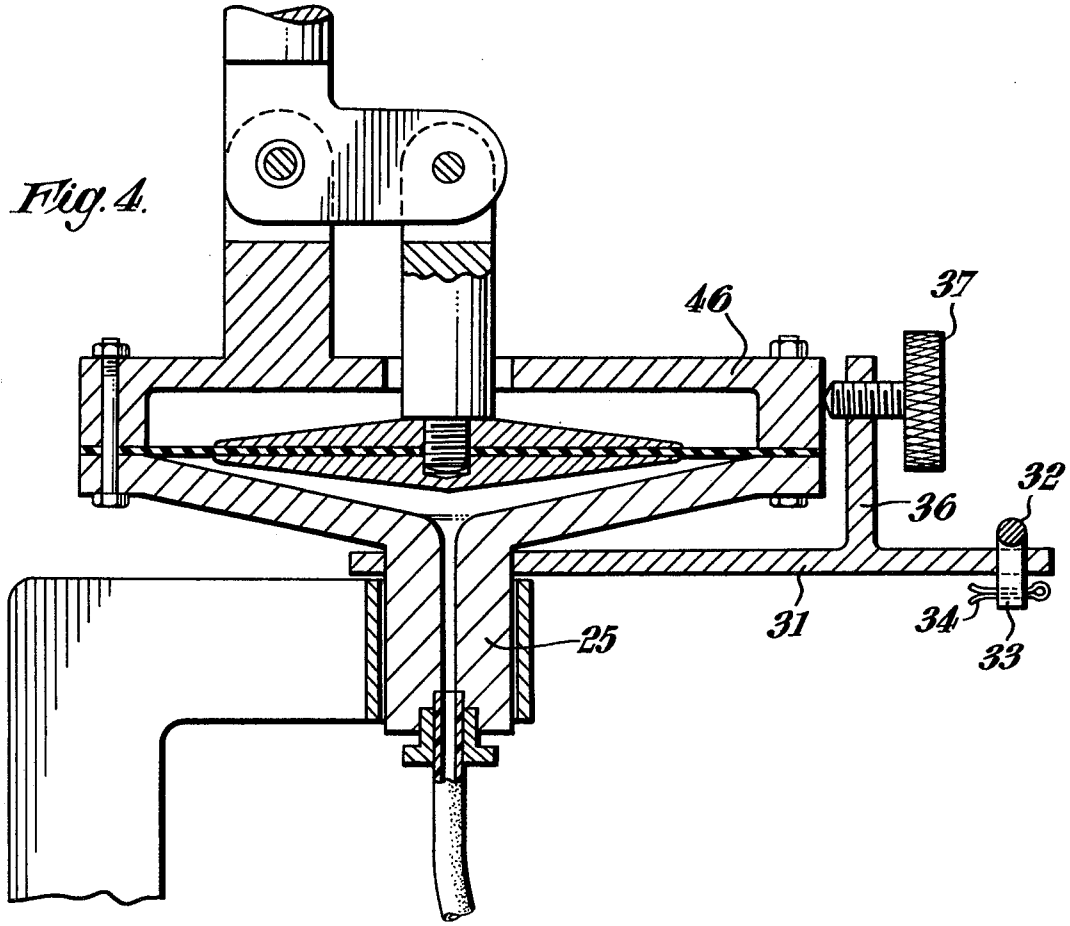
FIG. 4 is a sectional view of the pressure chamber with associated elements co-operating with the wind vane shown in FIG. 3.

To provide for damping of the main rudder, corresponding to the damping which would normally be effected manually, the system is constructed in the manner shown in FIGS. 3 and 4. The embodiments illustrated in these Figures correspond completely with the aforedescribed system with exception that the pressure-chamber housing, and therewith the wind vane, are pivotable in response to the main rudder.

According to this embodiment, which is shown in simplified form in FIGS. 3 and 4, there is pivotally mounted at one end on the hub 25 a link-arm 31 the other end of which is pivotally connected to a rod 32 having an end 33 which is bent inwardly at right angles, this end being inserted into a hole in the link-arm 31 and locked there by means of a split pin 34 or some other suitable securing means. The other end of the rod is pivotally connected to one end of a relatively short link-arm 35 the other end of which is firmly connected to the main rudder. The link-arm 31 has a lug 36 which projects up towards the periphery of the cap 46 and in which lug there is screwed a stop screw 37 arranged to lock the link 31 against the cap 36 subsequent to adjusting the main rudder and the wind vane to the desired position with regard to the prevailing wind direction.

The mode of operation of the system shown in FIGS. 3 and 4 coincides with the described mode of operation of the system shown in FIGS. 1 and 2 with the exception that when the main rudder 2 is rotated by the servo-rudder 3, when compensating for a deviation in course, the movement of the main rudder is transmitted, via the link-arms 35, 32 and 31 to the pivotable pressure-chamber arrangement and therewith to the wind vane. This movement, which can be transmitted from the main rudder to the wind vanes 16, counteracts the swinging movement which ceases completely or substantially completely when the vessel has been returned to the determined course position. Thus there is obtained a rudder operation which substantially corresponds to a manual damping action thereby preventing the vessel from moving in a zig-zag path. When the steering obtained with this system is too exact, which, for example, may be the case in a high sea when a zig-zag movement is to be preferred, the link-arm 32, for example, can be removed and the pressure-chamber system and wind vane locked relative to the vessel with a locking means of the type shown in FIG. 2.

In the aforegoing it has been assumed that the wind vane is pivotable around a horizontal or inclined shaft, although wind vanes having vertical pivot axes may also be used, in which case however, the movement-transmission mechanism between the wind vane and the pressure-chamber arrangement is slightly more complicated and therefore consumes more energy.

Although a servo rudder of the aforedescribed type is to be preferred with regard to small movements obtained directly from respective pressure chamber arrangements, it is also possible to use servo rudders which are not connected to the main rudder. Irrespective of which wind vane is used, the wind vane should be balanced with counterweights in a manner known per se.

When the pressure transmitting medium is air, it is convenient, as shown in FIGS. 1 and 3, for the line 9 to be connected to a venting valve 38, by means of which the closed system can communicate with atmosphere to empty the system.

It may be desirable to change the working characteristics of the closed system, and thus change the proportionality beween the movement of the wind vane and the movement and reaction time of the servo rudder. In accordance with the invention this is readily achieved by connecting the two pressure chambers together via, for example, two lines, of which one can be opened and closed by means of a valve incorporated in the line.

In order to obtain the desired damping function, the transmission in the link-arm system 31, 32, 35 may be made variable, for example, by making it possible to vary the length of the link-arm 32.

The described mechanical re-coupling arrangement for providing damping of the rudder can be replaced with any suitable arrangement capable of transmitting rudder movement to the pivotable pressure-chamber housing, and may, for example, comprise a pneumatic arrangement having a pressure-generating chamber of the type described adapted to be actuated by the rudder and a further chamber adapted to cause pivoting of the housing, these two chambers being arranged in a closed system.

Figure 5:
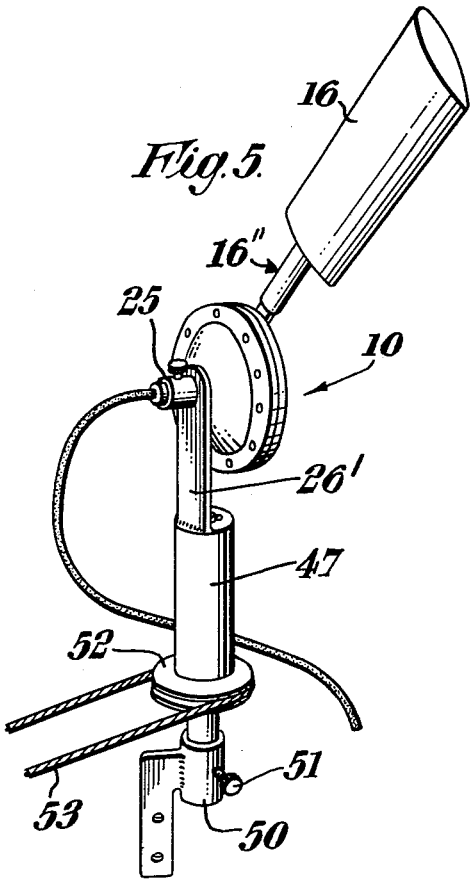
FIG. 5 illustrates wind-operated automatic steering gear according to the invention with the hub of the housing mounted horizontally.
Figure 6:
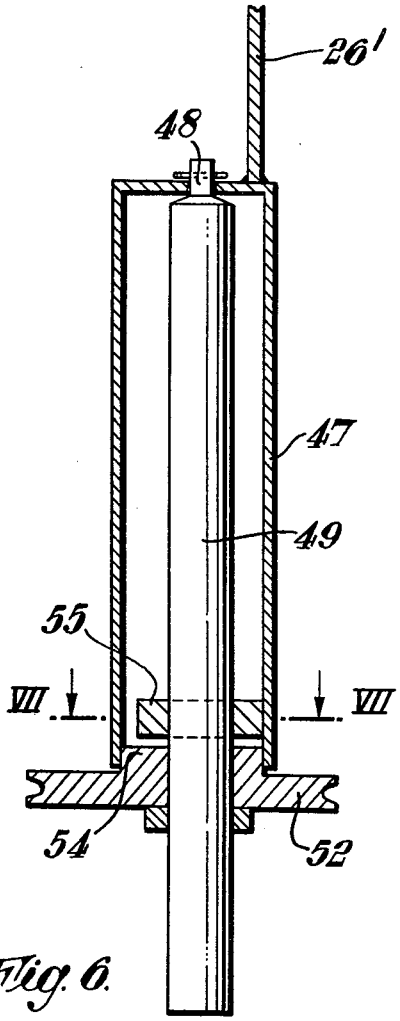
FIG. 6 is an axial sectional view of the adjustment means carrying the housing.
Figure 7:
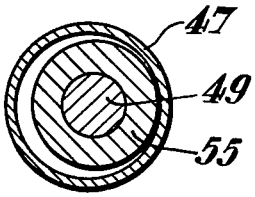
FIG. 7 is a sectional view taken on the line VII — VII of FIG. 6.

A modified system according to the invention is shown in FIGS. 5 – 7. In this embodiment, the wind vane 16 is coupled to the pressure chamber 10 shown in FIG. 2 with the hub 25 of the chamber horizontal and the bracket structure 26' is attached to a pipe 47 which has a closed upper end provided with a bearing hole for a pin 48 on a shaft 49, the lower end of which shaft is pivotally mounted in a fitting 50 intended to be attached to the yacht. The shaft 49 can be locked in a set position relative to the fitting 50 by means of a stop screw 51. The shaft 49 carries at its lower portion a pulley 52 for a line 53. The pulley has a hub 54 around which the pipe 47 is rotatably mounted. The hub 54 is eccentric in relation to the shaft 49. On the shaft, above the hub 54, there is journalled a drive wheel 55, which is manufactured, for example, from rubber so that its outer surface has a high coefficient of friction. The drive wheel 55 is concentric with the shaft 49 and has a diameter such that its drive surface abuts the inner surface of the pipe 47.

When the pulley 52 is caused to rotate by the line 53, the inner surface of the tube 47 will roll against the periphery of the drive wheel 55, but since the inner diameter of the tube is greater than the diameter of the drive wheel the tube, upon each revolution of the pulley 52, will be rotated slightly less and there is obtained a transmission ratio between the pulley 52 and the shaft 49 which depends directly upon the ratio of the inner diameter of the tube 47 and the degree of eccentricity. Accurate adjustment of the wind vane can thereby be obtained.

The post 16' carrying the wind vane 16 is preferably flexible and comprises, for example, a narrow tube made of a glass-fibre reinforced plastics material so as to be able to yield to wind gusts thereby preventing unnecessary actuation of the rudder.

Other modifications of the invention are possible within the scope of the following claims.

What I claim as my invention and desire to secure by letters patent of the United States is:

1. A wind-operated automatic steering gear for use on a water-going vessel to correct for deviations of said vessel from a desired course of travel, said steering gear comprising a housing, a wind vane pivotally mounted on said housing for being set in a neutral position and for being moved from such neutral position by the wind when the vessel deviates from said desired course, a main steering rudder, a servo-rudder hinged to the after edge of said steering rudder such that movement of said servo-rudder produces an opposite movement of said steering rudder, and a closed movement-transmission system connecting said wind vane to said servo-rudder; said transmission system comprising a first pressure chamber in said housing, one side of which chamber is closed by a first flexible diaphragm; a second pressure chamber, one side of which is closed by a second flexible diaphragm, said pressure chambers containing a pressure transmission medium and communicating with one another through at least one pressure-medium line, the arrangement being such that movement of one diaphragm is accompanied by a corresponding movement of the other diaphragm, a push-pull rod extending through one side of said housing and being connected at one end to a central section of said first diaphragm, a linkage system connecting the other end of said rod to said wind vane, said push-pull rod being effective to cause movement of said first diaphragm or said vane in response to movement of said vane or said first diaphragm respectively, said second diaphragm is connected to said servo-rudder by a further actuating device effective to move said second diaphragm or said servo-rudder in response to movement of said servo-rudder or said second diaphragm respectively, the housing on a side thereof remote from the push-pull rod being provided with a hub pivotally mounted in a carrier means having means for being attached to the water-going vessel, said hub having a through-flow passage communicating with said at least one pressure medium line, said passage having an area which is smaller than the area of the diaphragm, and means for locking the housing relative to said vessel.

2. A wind-operated automatic steering gear as claimed in claim 1 in which the wind vane is pivotable about a horizontal shaft or a shaft which is inclined to the horizontal plane, wherein the end of the push-pull rod projecting outwardly from one side of the housing is pivotally connected to one end of a link-arm attached to the wind vane.

3. A wind-operated automatic steering gear as claimed in claim 1, wherein the central portion of each diaphragm is reinforced with a plate-like member which carries said push-pull rod.

4. A wind-operated automatic steering gear for use on a water-going vessel to correct for deviations of said vessel from a desired course of travel, said steering gear comprising a housing, a wind vane pivotally mounted on said housing for being set in a neutral position and for being moved from such neutral position by the wind when the vessel deviates from said desired course, a main steering rudder, a servo-rudder hinged to the after edge of said steering rudder such that movement of said servo-rudder produces an opposite movement of said steering rudder, and a closed movement-transmission system connecting said wind vane to said servo-rudder; said transmission system comprising a first pressure chamber in said housing, one side of which chamber is closed by a first flexible diaphragm; a second pressure chamber, one side of which is closed by a second flexible diaphragm, said pressure chambers containing a pressure transmission medium and communicating with one another through at least one pressure-medium line, the arrangement being such that movement of one diaphragm is accompanied by a corresponding movement of the other diaphragm, a push-pull rod extending through one side of said housing and being connected at one end to a central section of said first diaphragm, a linkage system connecting the other end of said rod to said wind vane, said push-pull rod being effective to cause movement of said first diaphragm or said vane in response to movement of said vane or said first diaphragm respectively, said second diaphragm is connected to said servo-rudder by a further actuating device effective to move said second diaphragm or said servo-rudder in response to movement of said servo-rudder or said second diaphragm respectively, the housing on a side thereof remote from the push-pull rod being provided with a hub pivotally mounted in a carrier means having means for being attached to the water-going vessel, said hub having a through-flow passage communicating with said at least one pressure medium line, said passage having an area which is smaller than the area of the diaphragm, and resetting means operably connected to said steering rudder and said wind vane for moving said wind vane in response to movement of said steering rudder to return said wind vane to its neutral position and thereby resist over-travel of said vessel beyond said desired course of travel.

5. A wind-operated automatic steering gear as claimed in claim 4 in which the wind vane is pivotable about a horizontal shaft or a shaft which is inclined to the horizontal plane, wherein the end of the push-pull rod projecting outwardly from one side of the housing is pivotally connected to one end of a link-arm attached to the wind vane.

6. A wind-operated automatic steering gear as claimed in claim 4, wherein the central portion of each diaphragm is reinforced with a plate-like member which carries said push-pull rod.

7. A wind-operated automatic steering gear for use on a water-going vessel to correct for deviations of said vessel from a desired course of travel, comprising a housing rotatably mounted on the vessel, a wind vane pivotally mounted on the housing for being set in a neutral position and for being moved from such neutral position by the wind when the vessel deviates from said desired course, a main steering rudder, a servo-rudder hinged to the after edge of said steering rudder such that movement of said servo-rudder produces an opposite movement of said steering rudder, and a closed movement-transmission system connecting said wind vane to said servo-rudder; said transmission system comprises a first pressure chamber, one side of which is defined by a first flexible diaphragm; a second pressure chamber, one side of which is defined by a second flexible diaphragm, said pressure chambers containing a pressure transmission medium and communicating with one another through at least one pressure-medium line, the arrangement being such that movement of one diaphragm is accompanied by a corresponding movement of the other diaphragm, connected to said first diaphragm and said wind vane is a first actuating device effective to cause movement of said first diaphragm or said vane in response to movement of said vane or said first diaphragm respectively, said second diaphragm is connected to said servo-rudder by a further actuating device effective to move said second diaphragm or said servo-rudder in response to movement of said servo-rudder or said second diaphragm respectively, and resetting means operably connected to said steering rudder and said housing for rotating said housing and said wind vane in response to movement of said steering rudder to return said wind vane to its neutral position and thereby resist over-travel of said vessel beyond said desired course of travel.

8. A wind-operated automatic steering gear as claimed in claim 7, wherein the re-setting means includes an arm having means for mounting it to the main rudder of a vessel one end of which arm is pivotally connected to one end of a transmission link, the other end of which transmission link is pivotally connected to one end of an operating link and the other end of which operating link is pivotable in a plane substantially perpendicular to the axis of rotation of said housing and lockable to the housing in a desired set position by locking means.

9. A wind-operated automatic steering gear as claimed in claim 8, wherein said other end of the operating link is pivotally mounted on the housing.

* * * * *